United States Patent [19]

Kataoka et al.

[11] 4,116,367

[45] Sep. 26, 1978

[54] APPARATUS FOR SUPPLYING POWDER TO CONTINUOUS CASTING MOLD

[75] Inventors: Tohri Kataoka; Tetsuo Imi, both of Ohita, Japan

[73] Assignee: Nippon Steel Corporation, Tokyo, Japan

[21] Appl. No.: 739,450

[22] Filed: Nov. 5, 1976

[30] Foreign Application Priority Data

Nov. 12, 1975 [JP] Japan ..... 50-152894[U]
Nov. 20, 1975 [JP] Japan ..... 50-139615

[51] Int. Cl.[2] ..... B22D 45/00

[52] U.S. Cl. ..... 222/144.5; 164/73; 164/155; 164/418; 222/146 HS; 222/193; 222/424

[58] Field of Search ..... 164/55, 155, 72, 73, 164/149, 157, 268, 266, 273 R, 82; 222/193, 481.5, 146 HE, 146 HS, 144.5, 424

[56] References Cited

U.S. PATENT DOCUMENTS 2,833,443 5/1958 Prickett et al. ..... 222/146 HE
3,411,566 11/1968 Astrou et al. ..... 164/55
3,884,453 5/1975 Pearce et al. ..... 266/83
3,995,681 12/1976 Schmid et al. ..... 164/154

*Primary Examiner*—Francis S. Husar
*Assistant Examiner*—K. Y. Lin
*Attorney, Agent, or Firm*—Wenderoth, Lind & Ponack

[57] ABSTRACT

In an apparatus for supplying powder to a continuous casting mold, which has a powder hopper, a pneumatic powder-conveyor connected with the bottom portion of the powder hopper and a powder supplying nozzle connected with the pneumatic powder-conveyor, a heating and heat-retaining device and a gas injection device are mounted on the side wall of the powder hopper.

The heating and heat-retaining device is intended for maintaining the temperature of powder in the powder hopper within a required range, so as to keep its fluidity at a desired level, thereby preventing build-up of powder on the side wall of the powder hopper and its densification. The gas injection device is to inject dry gas into the powder hopper, so as to cause powder to flow down smoothly along the surface of the inside wall of the powder hopper.

10 Claims, 9 Drawing Figures

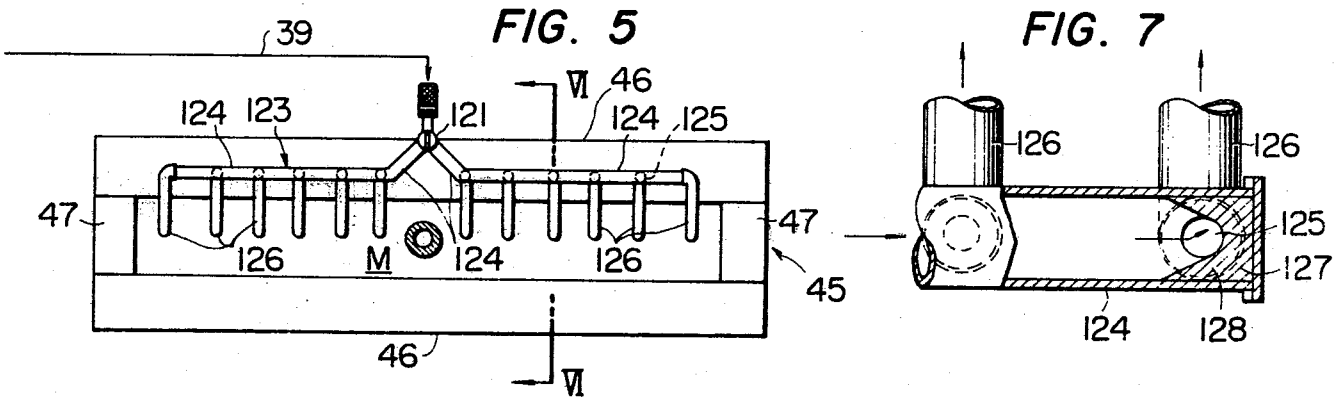
FIG. 7
FIG. 5
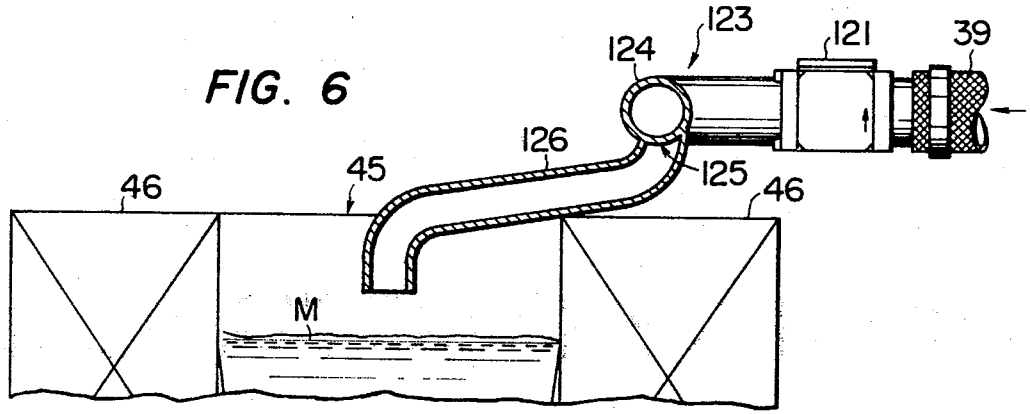
FIG. 6

APPARATUS FOR SUPPLYING POWDER TO CONTINUOUS CASTING MOLD

BACKGROUND OF THE INVENTION

The present invention relates to an apparatus for supplying powder, more specifically a powdery steel refining material, to a mold for continuous steel casting, that is, for spraying such material over the surface of molten metal in the mold.

There have been proposed a variety of methods of supplying powder to the mold. However, any such methods are not successful enough, because problems arise in the storing and transportation of powder and the condition of the supplied powder, particularly production of dust and uneven distribution thereof, and therefore none of the proposed methods have been used commercially. In practice, powder is supplied manually from the side of the mold by using rakes.

Moreover, such manual supply is done under very bad operating conditions, such as high temperature and space filled with dust. Therefore, there is a serious need for a method or apparatus which uses human hands as little as possible to be invented at the earliest possible date. A powder supplying apparatus is equipped, without exception, with a pneumatic powder-conveyor, which contains a powder supplying nozzle as a component. As for the powder supplying nozzle, it should function well to provide an even distribution of powder over the surface of molten metal in the mold, in such manner that choking of the nozzles and production of dust clouds are completely prevented, and observation of the surface of molten metal is made easy.

The powder supplying nozzles of the conventional type, for example are a pipe having simply a great number of holes in the longitudinal direction, but with variations in the number of holes; or are a pipe having a slit extending in the longitudinal direction. All these nozzles are positioned right above the surface of molten metal, constituting an obstacle to the observation or like work during the performance of the abovementioned function. Moreover, where the mold has a casting cross-section for casting a slab or a like shape which is flat, the nozzle must be moved horizontally in the long direction of the mold over the surface of molten metal by using a complicated driving mechanism, resulting in production of a dust cloud. Thus, it is difficult to properly lubricate the junction between the solidified shell of steel castings and the surface of the inside wall of the mold for the prevention of damage to the solidified shell and to collect floating slag on the surface of molten metal and maintain the temperature of the molten metal for producing pure steel.

In regard to the pneumatic powder-conveyor for supplying the mold, that is, pneumatically convey and spraying over the surface of molten metal in the mold, a powder, and more specifically a powdery refining material, conventionally used with the continuous casting apparatus, it is so designed from the standpoint of the layout of the necessary equipment on the working floor and for a greater availability of working space, that powder is pneumatically conveyed from the powder hopper and the conveying gas supply installed far from the mold through the main pneumatic powder-conveying pipe running to the mold, and is sprayed from the powder supplying nozzle which is connected at the end of said main pipe and positioned above the surface of molten metal in the mold.

Because the pneumatic powder-conveying main pipe is long as mentioned above, there is a posibility of build-up of powder in the main pipe after all the required powder has been conveyed and if conveying is interrupted, making it difficult to obtain smooth conveyance to the mold following an interruption or causing the pipe to be blocked at the worst.

SUMMARY OF THE INVENTION

It is an object of the present invention to provide an apparatus for supplying powder to a continuous casting mold, according to which apparatus powder can be transferred from the powder hopper to the pneumatic powder-conveyor while being maintained in a stabilized fluid condition, thereby making it possible to convey the powder through the pneumatic powder-conveying pipe of great length without any problem of blocking.

Another object of the present invention is to provide an apparatus for supplying powder to a continuous casting mold, according to which apparatus no dust cloud is produced by the supply of powder to the mold and automatic supply of powder is made possible.

A further object of the present invention is to provide an apparatus for supplying powder to a continuous casting mold, according to which apparatus powder can be smoothly supplied selectively from among a variety of sorts of powders contained respectively in a plurality of powder hoppers.

A still further object of the present invention is to provide an apparatus for supplying powder to a continuous casting mold, according to which apparatus build-up of the powder in the pneumatic powder-conveying pipe can be eliminated, thereby preventing blocking of the pneumatic powder-conveying pipe.

In order to achieve the abovementioned objects, the apparatus according to the present invention for supplying powder to a continuous casting mold comprises a pneumatic powder-conveyor connected with the powder hopper in the bottom portion of the hopper and a powder supplying nozzle connected with said pneumatic powder-conveyer, and a heating and heat-retaining device and a gas injection device are mounted on the side wall of said hopper.

BRIEF DESCRIPTION OF THE DRAWINGS

FIG. 5 is a plan view of another embodiment of the powder supplying nozzle according to the present invention.

FIG. 6 is a transverse sectional view of the nozzle of FIG. 5 taken on line VI—VI with an enlargement of the important part.

FIG. 7 is an enlarged cross-section of the important part of another embodiment of the nozzle of FIG. 6.

DESCRIPTION OF THE PREFERRED EMBODIMENT

Figure 1:
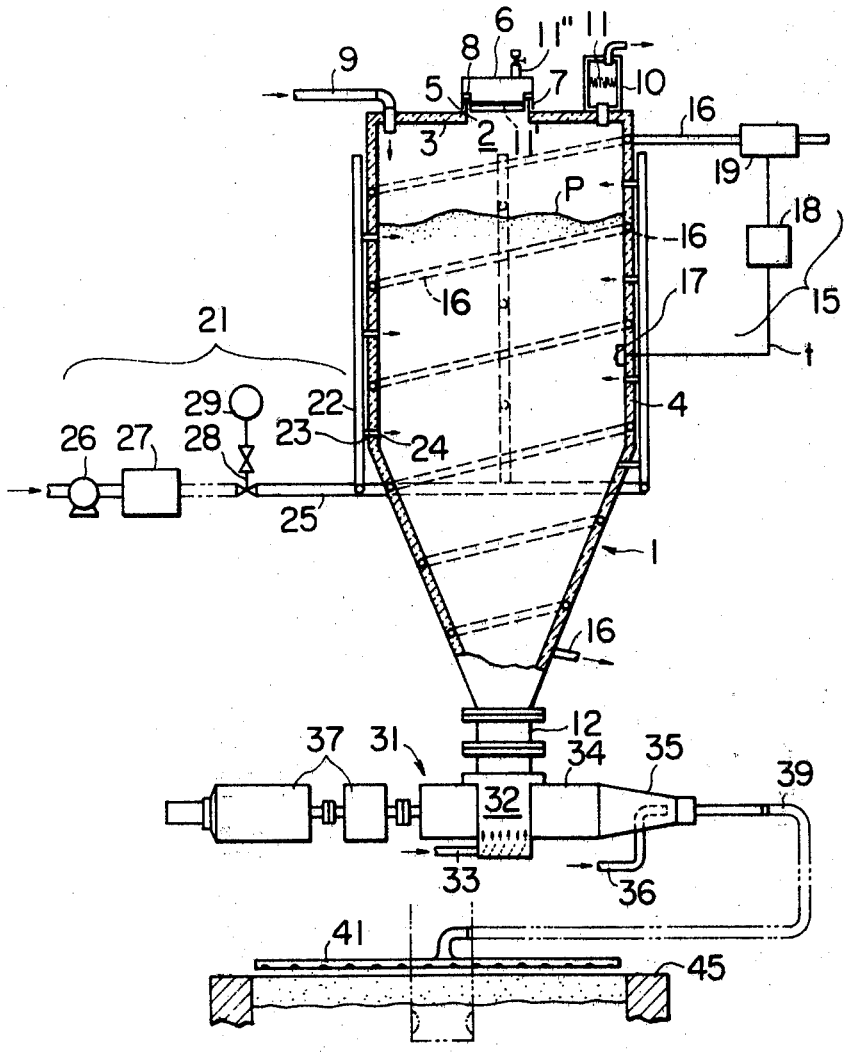
FIG. 1 is a side view, partly in cross-section, of the powder supplying apparatus according to the present invention showing one embodiment of the invention.

The powder supplying apparatus according to the present invention is so constructed to maintain high fluidity of powder P in a powder hopper 1 by the evaporation of the water content of the powder P by maintaining its temperature within a prescribed range of, say, 50°±5° C. and by the prevention densification of the powder which may occur due to dewing on the inside wall of the powder hopper 1. For this purpose, a heating and heat-retaining device 15 is mounted on the side wall 2 of the powder hopper 1. Moreover in order to control the level of powder by making the fall of powder along the wall of the powder hopper 1 smooth and to carry out smooth supply of powder to a pneumatic powder-conveyor 31, a gas injection device 21 is mounted on the side wall 2 of the powder hopper 1.

Referring to FIG. 1, the powder hopper 1 has the side wall 2 and the top portion 3 double-walled, and the space between the walls is filled with insulation 4, and the lower portion of the side wall 2 is funnel-shaped. The top portion 3 of the powder hopper 1 is provided with a powder inlet 5, which is closed by a lid 6. This lid 6 has the bottom end provided with groove 7 which is open downward, and which is provided with a gasket 8 in the bottom portion. Said gasket 8 is in contact with the upper end of the powder inlet 5. The powder inlet 5 and the lid 6 are thus sealed. A dry air supplying pipe 9 is connected to one side of the top portion 3 of the powder hopper 1, so that dry air can be supplied therefrom to the powder hopper 1, thereby maintaining positive pressure in the powder hopper 1 for preventing entry of air of high humidity from outside and drying powder P in cooperation with the heating and heat-retaining device 15 for reducing the water content of the powder to an appropriate level.

On the other side of the top portion 3 of the powder hopper 1 is provided an air-bleeding box 10 containing a bag filter 11 for dust-removal and exhaustion of the dry gas which has been supplied into the powder hopper 1. As a modification of said air-bleeding box 10, there may be provided a bag filter 11′ and an air bleeder 11″ on said lid 6.

The bottom portion of the powder hopper 1 is connected with a pneumatic powder-conveyor through a butter-fly valve 12. as shown in the figure, the heating and heat-retaining device 15 is equipped with a steam pipe 16 which extends spirally in the space between the double walls of the powder hopper 1 for carrying steam at high temperature, and also with a powder temperature sensor 17 which is provided inside the side wall 2 of the powder hopper 1. Temperature signals $t$ issuing from the powder temperature sensor 17 are sent to a controller 18, in which such signals $t$ are compared with the prescribed control range of the temperature, that is, 50°±5° C., and control a valve 19 for adjusting the supply of steam which is mounted in the steam pipe 16.

Although not shown, substitutes for said heating device can be provided in the form of electric coils, hot air piping or hot water piping.

Also as shown in the figure, the gas injection device 21 is equipped with a plurality of headers 22 extending vertically outside the side wall 2 of the powder hopper 1, each of such headers 22 having a plurality of gas jetting nozzles 23 provided at an appropriate distance from each other, each of the nozzles 23 extending through the side wall 2 of the powder hopper 1 and having, at the free end, a jet 24 directed toward the inside of the powder hopper 1. Each header 22 is connected with a dry air supplying main pipe 25, which is provided with an air supplying blower 26, a dehumidification cooler 27 and a valve 28 arranged in series. The valve 28 has a timer 29 set, so that it open and shuts alternately at short intervals as prescribed. Besides dry air, any inactive gas may be used for drying.

The pneumatic powder-conveyor 31 has the powder intake section 32 connected with an air jetting pipe 33, (in said section powder floats on upwardly directed jets of gas), and a floating powder section 34, and a forwarding powder section 35 (said section is connected with a conveying air pipe 36) arranged in series on the outlet side of the powder intake section 32. In said powder forwarding section 35 there is provided a screw (not shown) driven by a driving device 37.

Powder which has fallen from the powder hopper 1 into the powder intake section 32, floats on air blown up from the air jetting pipe 33, and then is sent by a screw to the powder forwarding section 35. The powder in the powder forwarding section 35, is caught by horizontal jets from the conveying-air pipe 36, and sent to a powder supplying nozzle 41 through a penumatic powder-conveying main pipe 39.

As is clear from the foregoing descriptions, in, the present invention in the powder hopper for the pneumatic powder-conveyor, stabilized fluidity of the powder is obtained by maintaining the water content at an appropriate level and by controlling the temperature within a prescribed range, and such powder is supplied smoothly to the powder intake section of the pneumatic powder-conveyor, moving smoothly down along the surface of the inside wall of the powder hopper, thereby making possible good mixing of conveying gas the powder and good conveyance of the mixture, making possible smooth conveyance through the pneumatic powder-conveying pipe over a very long a distance to the powder supplying nozzle 41 of a mold 45 on account of pulsation of compression waves, and also making possible uniform distribution of powder spray in the mold 45 without production of a dust cloud. Besides the above-mentioned embodiment in which one powder hopper is used, there is provided another embodiment suited for cases where a variety of powders are supplied selectively to one mold. The structure of the powder supplying apparatus described below is suited for such cases.

Figure 2:
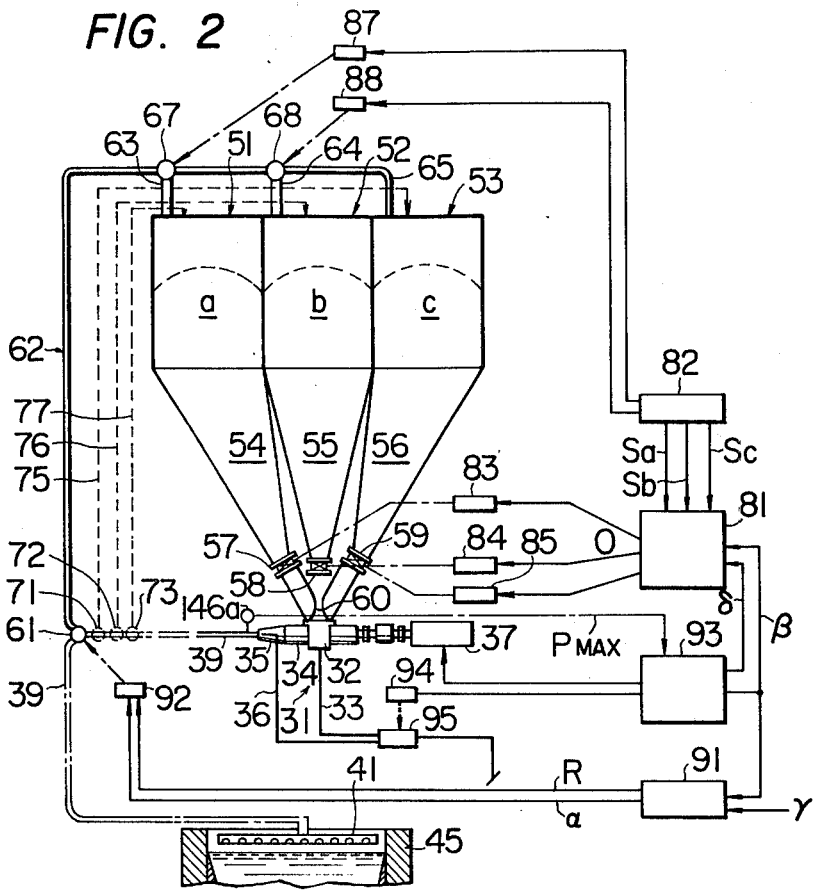
FIG. 2 is a side view, partly in cross-section, of the powder supplying apparatus according to the present invention, which is equipped with three powder hoppers.

Referring to FIG. 2, a plurality of powder hoppers 51, 52 and 53 are mounted together, and powder discharging pipes 54, 55 and 56 for the respective hoppers have their respective top portions connected with a header 60 respectively through dampers 57, 58 and 59. The header 60 has the bottom end connected with the powder intake section 32 of said pneumatic powder-conveyor 31. The pneumatic powder-conveying main pipe 39 connected with the outlet side of the pneumatic powder-conveyor 31 is provided with change-over mechanisms, such as two-way valves 61, 67 and 68.

Extending upwardly from said change-over valve 61 is a pneumatic powder-returning pipe 62 from said pneumatic powder-returning pipe 62 branch pipes 63, 64 and 65 are connected with the respective top portions of the powder hoppers 51, 52 and 53. Change-over valves 67 and 68 are provided at the connections of pipe 62 with branch pipes 63 and 64, respectively.

As a modification of the above-described construction, there may be used a construction in which there is substituted for the change-over valves 61, 67 and 68 and the pneumatic powder-returning pipe 62 and the like, change-over valves 71, 72 and 73 provided in the pneumatic powder-conveying main pipe 39, and which are connected with the respective top portions of the powder hoppers 51, 52 and 53 respectively by pneumatic powder-returning pipes 75, 76 and 77, all as shown in dotted lines in FIG. 2.

In the apparatus of the above-described construction, any one of powders *a*, *b* and *c* stored respectively in the powder hoppers 51, 52 and 53 is selectively taken into the powder intake section 32 of the pneumatic powder-conveyor 31 from the respective powder discharging pipes 54, 55 and 56 through the header 60 by operating the respective dampers 57, 58 and 59, respectively, of the powder hoppers 51, 52 and 53 corresponding to the selected powder; and then the powder is supplied to the mold 45 from the powder supplying nozzle 41 provided right above the mold 45 through the floating powder section 34, the powder forwarding section 35 and the pneumatic powder-conveying main pipe 39.

When changing from one kind of powder over to another, or in case of a long interruption in pneumatic powder-conveyance during casting work the damper 57, 58 and 59 for the powder hopper 51, 52 or 53 corresponding to the powder which had been selected and supplied continuously by the operation of the pneumatic powder-conveyor 31 just before the change-over or interruption is closed.

Then, there is carried out the change-over of the return loop by using the change-over mechanism, that is, the two-way valve 61 mounted in the pneumatic powder-conveying main pipe 39 and two-way valves 67 and 68 mounted in the pneumatic powder-returning pipe 62 or by using the two-way valves 71, 72 and 73 provided, respectively, at the respective connections of the pneumatic powder-conveying main pipe 39 with the respective powder-returning pipes 75, 76 and 77, so that the powder which remains downstream of the corresponding damper 57, 58 or 59 is returned to its own hopper 51, 52 or 53, thereby eliminating powder from the main parts of pneumatic powder-conveyor, preventing the pneumatic powder-conveyor from being blocked by build-up or densification of the powder in these parts and preventing mixing of different sorts of powders.

In FIG. 2, 81 denotes a first control section, in which selection instruction signals (one of signals S*a*–S*c*) issuing from a powder an selector 82 is introduced, and held as AND element signal to move the dampers 57, 58 and 59, respectively, of said powder hoppers 51, 52 and 53 to the open state respectively, by means of switching-driving mechanisms 83, 84 and 85; and the return loop through the branch pipes 63, 64 and 65 from the pneumatic powder-returning pipe 62 and respectively to said powder hoppers 51, 52 and 53, are formed beforehand by means of the switching-driving mechanisms 87 and 88, respectively, for the two-way valves 67 and 68 which are also controlled from powder selector 82; and signal $\beta$ which is the instruction to stop operation of the pneumatic powder-conveyor 31 is supplied to the control section 81 to drive the switching-driving mechanisms 83, 84 and 85, respectively, to close the dampers 57, 58 and 59 which are in the open state.

A second control section 91 is provided in which a powder supply preparation signal $\alpha$ which issues as needed, operates a switching-driving mechanism 92 so as to switch the two-way valve 61 to direct powder to the pneumatic powder-conveying main pipe 39; and when signal $\beta$ for stopping operation of the pneumatic powder-conveyor 31 or a powder changing signal $\gamma$ is supplied thereto, such signal causes a powder return signal R to issue to the switching-driving mechanism 92 after passage of a time required for eliminating powder remaining in the pneumatic powder-conveying main pipe 39 as described below, so as to switch the two-way valve 61 to direct powder to the pneumatic powder-returning pipe 62.

An operation control section 93 for the pneumatic powder-conveyor 31 is provided, which after all preparations have been made for the start of operation, sends a start signal $\alpha$ to the first control section 81 to cause a signal S*a*–S*c* held as an AND element signal O to issue for the switching-driving mechanisms 83, 84 and 85 to open one of the respective dampers 57, 58 and 59 thereof, and operates a switching-driving mechanism 94 to open a valve 95 for supply of air to the conveying air pipes 33 and 36, thereby making a selected powder (*a*–*c*) fall into the powder intake section 32 for floating in air therein; and after a prescribed length of time has passed the operation control signal section 93 operates the driving device 37 to rotate the screw of the floating powder section 34, thereby sending the powder from the powder intake section 32 to the powder forwarding section 35, which section then presses the powder into the pneumatic powder-conveying air pipe 36.

Stopping the operation is carried out as follows: The operation control section 93 is set for stopping operation or maximum pressure detecting signal P max issuing from the pressure sensor 146*a* provided on the outlet side of the powder forwarding section 35 is supplied to control section 93 to make the motor 37 stop for a prescribed time; and operation-stop signal $\beta$ is sent to the control section No. 81 to close the damper of the powder hopper for the powder which has been supplied, so as to discharge the powder in the pneumatic powder-conveying main pipe from the powder supplying nozzle 41; and then the motor 37 is again driven and the control section 91 takes the above-described control action (that is, to close the damper and switch the two-way valve 61 to the pneumatic powder-returning pipe 62); and after a prescribed time has passed (that is, a time required for returning powder from below the damper and from the pneumatic powder-conveyor 31 to the powder hopper), the motor 37 is stopped, and the switching-driving mechanism 94 operates for shutting the valve 95 of the air pipes 33 and 34.

As is clear from the foregoing, the apparatus of the present invention is so constructed that one conveyor for pneumatic conveyance of powder functions for smoothly supplying a selected powder to the mold from among one of a plurality of powder hoppers, in which are contained respectively different powders, without mixing of different powders, thus improving the continuous casting plant so that the plant can be made compact and constructed at much smaller cost than conventionally.

Figure 3:
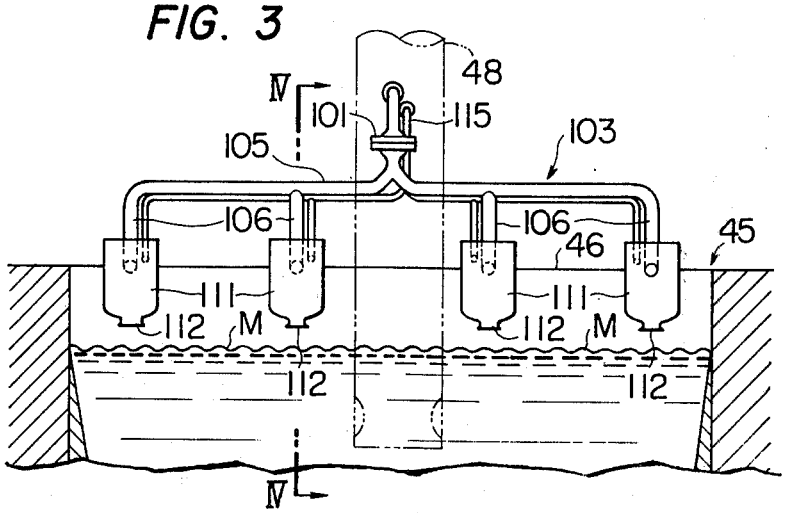
FIG. 3 is a front view of one embodiment of the powder supplying nozzle according to the present invention.
Figure 4:
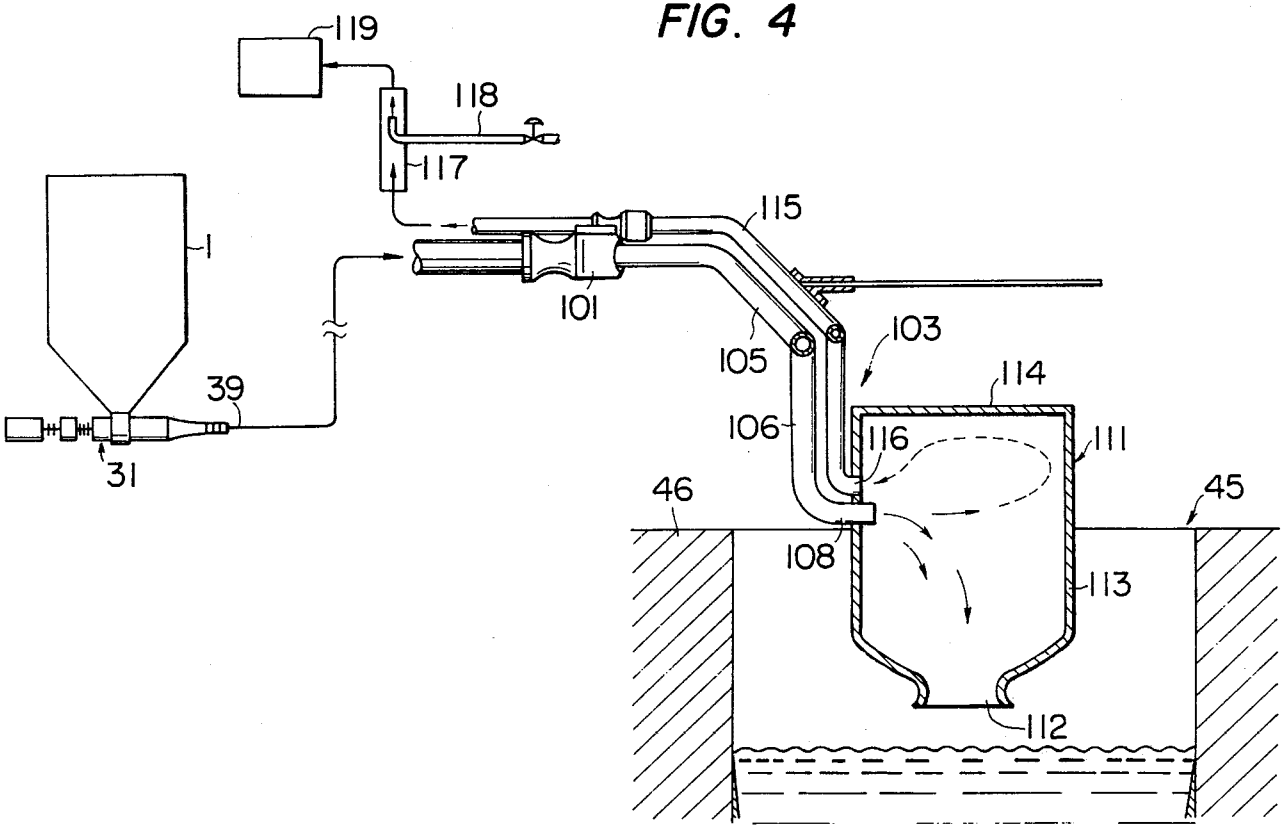
FIG. 4 is a transverse sectional view of the nozzle of FIG. 3 taken on line IV—IV with an enlargement of the important part.

The following is a description of a nozzle for spraying powder over molten metal in the mold:

Referring to FIGS. 3 and 4, the pneumatic powder-conveying pipe 39 has the end fitted with a powder supplying nozzle 103 connected thereto through a two-way valve 101. The powder supplying nozzle 103 is provided with a branched pipe 105 connected with the two-way valve 101, and also with a plurality of distributing pipes 106 extending from said branched pipe 105.

The branched pipe 105 extends horizontally along the line side 46 of the mold 45 right above said side, so as to spray powder on the surace M of molten metal, and extends in opposite directions from an immersed nozzle 48 set at the central portion of the mold 45. The distributing pipes 106 extend from the branched pipe 105 down toward the surface M of the molten metal; and their respective bottom portion 108 is curved to extend horizontally above the surface M of molten metal, to constitute a powder jet.

At the end of the bottom portion 108 of each of the distributing pipes 106 is provided a chamber 111 having a powder spraying port 112 opening downward. The caliber of the powder spraying port 112 is smaller than the inner cross-sectional area of the body of the chamber 111, so that the chamber 111 is shaped like a bottle.

The respective bottom portions 108 of the distributing pipes 106 run through the wall 113 of the chamber 111 at a level half the height of the chamber 111, and are open toward the central axis of the chamber 111.

A suction pipe 115 which extends along the branched pipe 105 and the distributing pipes 106, has the bottom portions 116 opening into the chambers 111, in the same manner as the respective portions 108 of the distributing pipes 106.

Said suction pipe 115 is connected with an air-powder separating chamber 119 through an ejector 117 having a compressed air pipe 118 opening thereinto.

In the powder supplying nozzle having this construction, jets of powder pneumatically conveyed through the pneumatic powder-conveying main pipe 39 by the pneumatic powder-conveyor 31, are introduced into the chambers 111 for reducing the pressure thereof. An amount of the powder conveying gas which has been jetted into the chamber 111 is drawn out by the suction pipe 115 equal to the volume jetter in, so that powder is separated from conveying gas in the chamber; therefore, only powder flows down along the inside surface of the wall 113 of the chamber 111, and falls from the powder spraying port 112 which is tapered, so as to be sprayed over the surface M of the molten metal.

The bottom portions 116 of the suction pipe 115 should preferably be directed to create suction in a direction opposite to the discharging direction of the respective end portions 108 of the distributing pipes 106, thereby preventing suction of different sorts of powders mixed together.

For this purpose, the suction pipe 115 may be positioned so that it extends perpendicularly through the top 114 of the chamber 111, with its end portion facing downward.

If the respective end portions 108 of the distributing pipes 106 are directed tangentially to the circumferential wall 113 of the chamber 111, separation of powder from the conveying gas will be more efficient.

Use of said powder supplying nozzle will makes it possible to spray powder uniformly over the surface of the molten metal in the mold without production of a dust cloud around the mold; therefore, it is possible to provide appropriate lubrication between the inside surface of the wall of the mold and the solidified shell, efficiently collect floating slag and retain heat at the surface of the molten metal, and continuously produce castings having good surface and interior properties.

The following is a description of another embodiment of the powder supplying nozzle:

Referring to FIGS. 5 and 6, the pneumatic powder-conveying main pipe 39 has the end fitted with a two-way valve 121; and said two-way valve 121 is fitted with the powder supplying nozzle 123 having a branched pipe 125.

The powder supplying nozzle 123 is so constructed that the branched pipe 124 extends along the long side 46 of the mold 45 parallel with the long direction of said long side 46, and has a number of powder jetting holes 125 therein at equal intervals and with the size of the holes increasing the farther they are away from the central point of said branched pipe 124 toward the respective ends of said frame 47, so as to spray floating powder uniformly over the surface of molten metal; at each of the powder jetting holes 125 there is connected to the pipe 124 the upper end of a hood 126 having the diameter greater than that of the corresponding powder jetting hole 125; the lower end of each hood 126 is positioned in the open space at the top the mold 45 nearly along the center line parallel with the long side of the mold 45; and all the hoods 126 have the respective opening at the lower end facing the surface M of the molten metal in the mold 45, whereby the powder-gas mixture jetted from the powder jetting holes 125 has the pressure reduced in the hoods 126 before the powder is sprayed over the surface M of the molten metal in the mold 45.

FIG. 7 shows one embodiment of the construction of the ends of the branched pipe 124. The respective ends of the branched pipe 124 are stuffed with packings 128 in such manner as not to block the powder jetting hole 125. Therefore, no powder will collect in the end portion 127, when the flow of powder is stopped, so that no blocking of the powder jetting hole 125 occurs due to densification of powder or in case different powders are supplied to the mold 45, and no mixing of different powders takes place.

As made clear in the foregoing, the powder supplying nozzle of the present invention has a simple construction, but is capable of dividing a current of air with powder floating therein sent through a branched pipe facing the side of the mold so as to be evenly distributed to the powder jetting holes, so that the powder jetted from the powder jetting holes has the pressure reduced in the hoods, which lead the powder to the open top of the mold and discharge the powder slowly from the discharging mouth so as to be sprayed over the surface of molten metal without production of a dust cloud around the mold.

The application of an appropriate amount of powder between the solidified shell of molten metal in the mold and the inner surface of the wall of the mold produces the desired lubrication for the prevention of damage of the solidified shell, makes collection of slag floating near the surface of molten metal easy and ensures retention of heat of the molten metal, thereby making possible production of refined steel.

Figure 8:
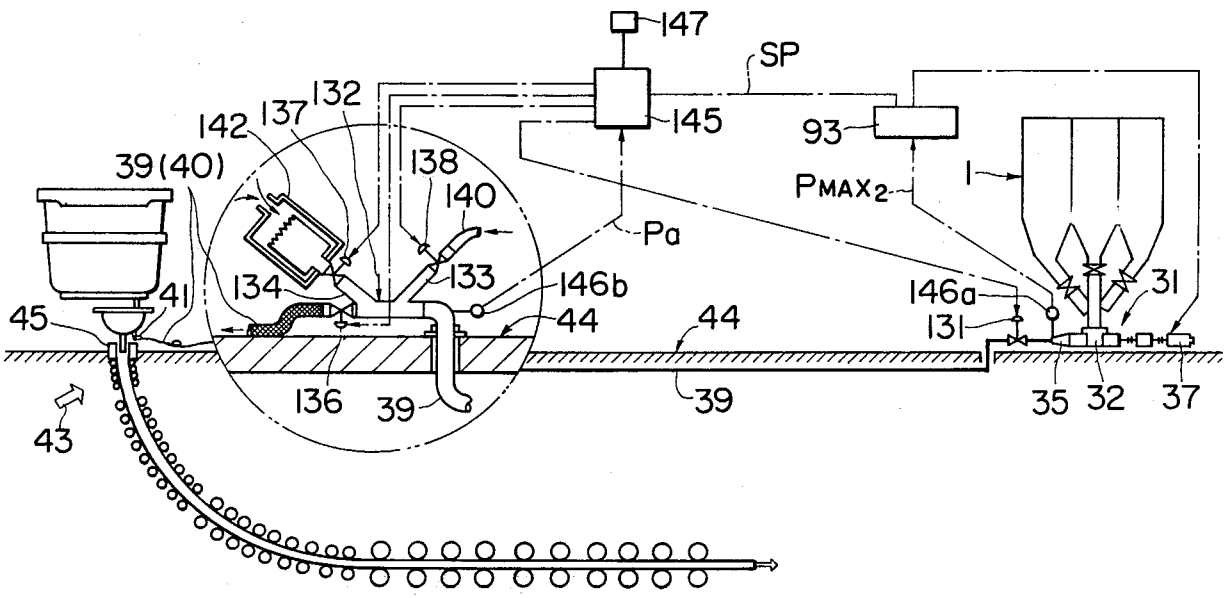
FIG. 8 is a schematic view of one embodiment of the device according to the present invention for elimination of build-up of powder in the pneumatic powder-conveying pipe with an enlargement of the important part.

The following is a description of a device for the prevention of blocking of the pneumatic powder-conveying pipe with powder:

In the embodiment shown in FIG. 8, 43 denotes a continuous casting machine; 45 denotes a mold, 1 denotes powder hoppers installed at the end of the continuous casting floor; 31 denotes a pneumatic powder-conveyor having the powder intake section 32 connected with the lower discharging section of said powder hopper 1; 39 denotes a main pneumatic powder-conveying pipe (nearly all laid on the continuous casting floor 44 and being flexible pipe 40) having the upstream end connected with the powder forwarding section 35 of the pneumatic powder-conveyor 31, and having the downstream end connected with the powder supplying nozzle 41 provided above the surface of molten metal in the mold; 131 denotes a valve provided in the upstream end of the pneumatic powder-conveying main pipe 39; 132 denotes a four-way pipe provided on the downstream end of the pneumatic powder-conveying main pipe 39 and having valves 136, 137 and 138 provided thereon; 140 denotes a compressed air pipe connected with the branch pipe 133 of the four-way pipe 132; 142 denotes a bag filter connected with the branch pipe 134 of the four-way pipe 132; 93 denotes the operation control section of the pneumatic powder-conveyor 31; 145 denotes a powder choking elimination controller for controlling the valves 131, 136 and 137, the controller 145 keeping the valves 131 and 136 open and the valves 137 and 138 closed while the pneumatic powder-conveyor 31 is in operation.

Upon issuance of an abnormal operation pressure detecting signal (Pmax 2) from the pressure sensor 146*a*, the operation control section 93 stops the motor 37, and it also introduces a stop signal SP into the controller 145; when the controller 145 is thus turned "ON", the valves 131 and 136 are closed, and then, the valve 138 is opened so as to fill the section between the valves 131 and 136 of the pneumatic powder-conveying main pipe with compressed air supplied from the compressed air pipe 140.

Supplying of compressed air continues until the valve 138 is closed by the introduction of a signal indicating detection of the prescribed pressure sent from pressure sensor 146*b* mounted on the pneumatic powder-conveying main pipe 39. Right after that, the valve 137 is opened for a moment for pressure reduction, and as a result of the pressure reduction, the powder remaining in the pneumatic powder-conveying main pipe 39 is discharged from the pipe and introduced into the bag filter 142 for recovery of powder separated from air. After a time has passed, the valves resume the original positions, that is, the valves 131 and 136 are open state, and the valves 137 and 138 are closed or "OFF". In the figure, 147 denotes a setting means for setting the number of repetitions where the process of charging of compressed air, stopping of charging of compressed air in response to a prescribed pressure detecting signal Pa, and discharge of powder from the pipe is repeated.

Figure 9:
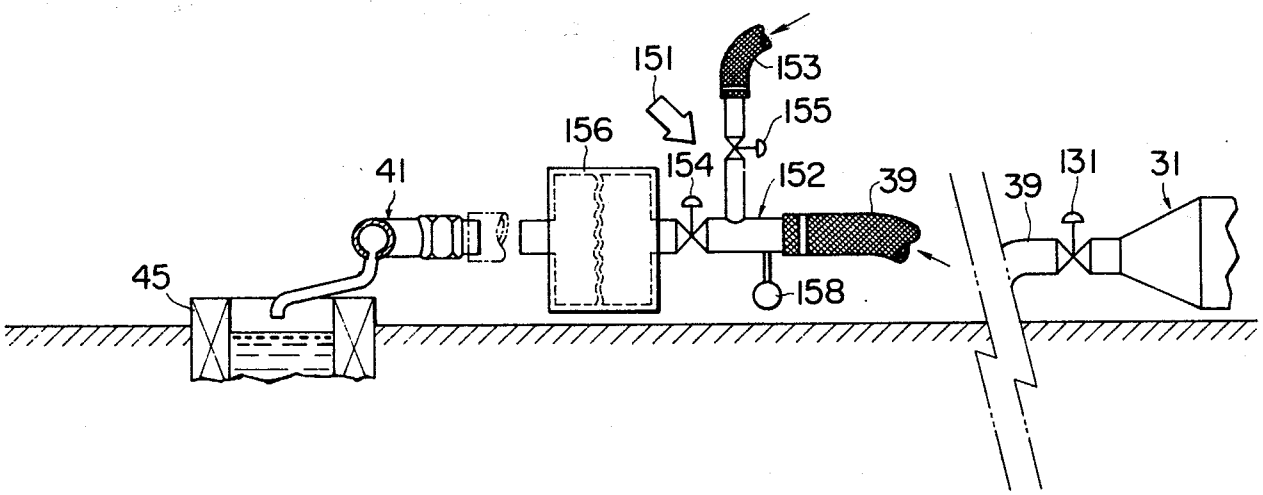
FIG. 9 is a schematic view of another embodiment of the device according to the present invention for elimination of build-up of powder in the pneumatic powder-conveying pipe with an enlargement of the important part.

The embodiment shown in FIG. 9, is an apparatus for manual operation, and therefore, it is different from the embodiment of the present invention which operates automatically.

When the supply of powder to the mold 45 has been completed the powder supplying nozzle 41 is removed from the end of the pneumatic powder-conveying main pipe 40, and instead, a powder eliminating instrument 151 is connected therewith. Said powder eliminating instrument 151 consists of a tee 152 which has a valve 154 and a valve 155 thereon, respectively, on the end portion of the main pipe and on the branch portion, a compressed air pipe 153 connected with said branch portion of the tee 152 and a bag filter 156 connected with the end portion of the main pipe of the tee 152. After connecting said instrument 151, said valve 154 and a valve (not shown) which is mounted at the upstream end of the pneumatic powder-conveying main pipe 40 are closed, then the valve 155 is opened so as to fill the pneumatic powder-conveying main pipe 40 with compressed air supplied from the compressed air pipe 153; and when a pressure gauge 158 provided on the main pipe of the tee 152 indicates the prescribed pressure, the valve 155 is closed to stop charging of compressed air; then, the valve 154 is opened for a moment so that the powder remaining in the pneumatic powder-conveying main pipe 40 is sucked together with the compressed air into the bag filter 156, in which separation of air and powder is carried out to recover the powder.

The attached Table 1 shows the results of operation the abovementioned embodiments of the apparatus of the present invention.

As is clear from the foregoing, the apparatus of the present invention ejects powder from the pneumatic powder-conveying main pipe speedily, completely and without production of a dust cloud, and recovers it, thereby making it possible to pneumatically convey powder smoothly through the pneumatic powder-conveying main pipe to the powder supplying nozzle without blocking of the pipe, thus ensuring a stabilized supply of powder to the mold during the process of continuous casting.

Table 1

| | Examples | | | 1) | 2) | 3) | 4) |
|---|---|---|---|---|---|---|---|
| I | Composition of powder | | | Mainly containing $SiO_2$, and CaO (≈70%) | | | |
| II | Pneumatic powder-conveying main pipe 39 | (1) Powder eliminating zone(between valves 131 and 136 or 131 and 154) | Length (m) | 10 | 20 | 40 | 60 |
| | | | Inner dia. (mm) | 21.6 | 21.6 | 27.6 | 27.6 |
| III | Pressure ($Kg/cm^2$) after high compressed air is charged in the pneumatic powder-conveying main pipe 39. | | | 5 | 6 | 7 | 5 |
| IV | Time (sec.) required for completely opening valves 137 and 154 for opening the pneumatic powder-conveying main pipe 39. | | | 0.5 | 0.5 | 0.5 | 0.5 |
| V | Number (times) of practising III and IV | | | 5 | 8 | 12 | 20 |
| VI | (Effect) Whether or not powder remains is the pneumatic powder-conveying main pipe 39 after practising III - V. | | | nothing | nothing | nothing | nothing |

What is claimed is:

1. An apparatus for supplying powder to a continuous casting mold comprising:

a plurality of powder hoppers arranged side by side, each having a funnel shaped bottom portion;

a plurality of dampers connected with the bottom end of the respective hoppers;

a header connected with said dampers;

a pneumatic powder conveyor connected to the bottom of said header for conveying powder to the mold, said conveyor having a powder intake which communicates with said dampers through said header, a powder forwarding portion connected with the powder intake section, and a means for directing pressurized air into said powder conveyor for entraining the powder in the air;

a powder supply nozzle means for positioning above the casting mold;

a main pneumatic powder conveying pipe having one end connected with said powder forwarding portion of said pneumatic powder conveyor and the other end connected with said nozzle means;

a pneumatic powder returning means connecting an intermediate point of said main pipe with the top portions of the respective hoppers; and a changeover mechanism in the connection between said main pipe and said returning means for changing over the connection between the main pipe and the returning means for returning powder to the hoppers.

2. The apparatus as claimed in claim 1 in which each powder hopper has a heating means mounted on the side wall of said powder hopper for heating powder in said powder hopper to a required temperature and for maintaining the temperature at such level, and a gas injection means having a plurality of nozzles mounted in the side wall of said powder hopper for injecting dry gas into said powder hopper.

3. The apparatus as claimed in claim 2, wherein said heating means comprises a steam pipe provided around the side wall of the powder hopper for carrying steam of high temperature, a temperature sensor mounted on the side wall of the powder hopper for sensing the temperature of the powder within the hopper, a control valve mounted on the inlet end of the steam pipe, and a control means connected between said sensor and said control valve for sending to the control valve operation signals produced in accordance with signals from the temperature sensor for controlling the supply of steam to the steam pipe for maintaining the temperature of powder in the powder hopper within the required range; and said gas injection means comprises a plurality of headers extending along the side wall of the powder hopper, a plurality of said injection nozzles being mounted on each of the headers, each of said nozzles extending through the side wall of the powder hopper and being directed toward the center of the powder hopper, and a means for supplying intermittently and for short times a compressed dry gas to said headers.

4. The apparatus as claimed in claim 2, further comprising a damper opening and closing means connected to said dampers for opening and closing said dampers, a means for selecting the hopper from which powder is to be supplied to the mold and connected to said damper opening and closing means and to said changeover mechanism for operating the changeover mechanism for changing over the connection between said powder hoppers and said pneumatic powder returning means and for operating the damper opening and closing means, and an operation controller connected to said pneumatic powder conveyor and to said damper opening and closing means for controlling operation of the pneumatic powder conveyor for removal of powder remaining in the conveying pipe and for sending damper opening or closing signals to the damper opening and closing means.

5. The apparatus as claimed in claim 2, wherein said powder supplying nozzle means comprises a branched pipe connected to the pneumatic powder conveying pipe and branched at the center thereof, a plurality of distributing pipes each extending downward from the branched pipe and having the lower end portion bent in the horizontal direction for forming a powder discharging mouth, a chamber connected with each of the respective distributing pipes and being open downward and having the powder spraying port with a diameter smaller than the inner diameter of said chamber, said powder discharging mouth of the corresponding distributing pipes opening into said chambers, a suction pipe connected to each chamber, and a means for sucking the gas for conveying the powder which enters the chamber with the powder by means of the suction pipe, whereby the powder which has been pneumatically conveyed into the chamber together with conveying gas from the main pneumatic powder-conveying pipe through the branched pipe and the distributing pipes moves down along the inside surface of the chamber and is discharged from the powder spraying port of the chamber without being under pneumatic pressure.

6. The apparatus as claimed in claim 2, wherein said powder supplying nozzle means comprises a branched pipe connected to the pneumatic powder conveying pipe and branched at the center thereof, said branched pipe having a plurality of powder discharging holes therein and hoods mounted on the branched pipe so as to be connected with the respective discharging holes, each of said hoods having an open end directed downwardly, the branched pipe having the interior of both ends stuffed with packing while leaving the powder discharging mouth open, thereby preventing build-up of powder at the end portions.

7. The apparatus as claimed in claim 2, further comprising a means connected to said main pneumatic powder-conveying pipe for supplying compressed gas into said main pneumatic powder conveying pipe, a means connected to said main pneumatic powder-conveying pipe for releasing the compressed gas suddenly from the main pneumatic powder conveying pipe, and a powder separator connected to said main pipe for receiving the powder remaining in the main pipe together with the released gas.

8. The apparatus as claimed in claim 7, wherein said means for supplying compressed gas comprises a first stop valve and a second stop valve mounted on the main pneumatic powder conveying pipe, a compressed gas supply, and a third stop valve connecting the compressed gas supply with the pneumatic powder-conveying pipe for supplying gas at high pressure to said main pneumatic powder conveying pipe, and said means for releasing the compressed gas comprises a pipe branched from the main pneumatic powder conveying pipe and a fourth valve on said branched pipe having the outlet side connected with said powder separator, said third and fourth valves being located between said first and second stop valves.

9. An apparatus as claimed in claim 8, further comprising a control means connected to said pneumatic powder conveyor for controlling operation of said pneumatic powder conveyor, and a further control means connected to said four stop valves and to said control means for controlling the opening and closing of said four stop valves in accordance with signals sent from said control means, said further control means having means for opening the first and second stop valves and closing the third and fourth stop valves while the pneumatic powder conveyor is in operation and closing the first and second stop valves and opening the third and fourth stop valves when pressure on the outlet side of the gas forwarding section of the pneumatic powder conveyor becomes abnormal for filling the section between the first and second stop valves of the main pipe with high pressure gas, and then closing the third stop valve and then opening the fourth stop valve for a moment.

10. The apparatus as claimed in claim 7, wherein said means for supplying compressed gas comprises a tee in the main pipe and a stop valve on the branch pipe of said tee and a compressed gas supply connected to said stop valve for supplying gas at high pressure to the main pipe; and a further valve on the outlet of the main pipe of the tee and to which said powder separator is connected.

* * * * *